US007405248B1

(12) United States Patent
Tröger et al.

(10) Patent No.: US 7,405,248 B1
(45) Date of Patent: Jul. 29, 2008

(54) PLATE-SHAPED MOULDING ELEMENTS BASED ON NATURAL FIBRES AND METHOD FOR THE PRODUCTION THEREOF

(75) Inventors: Matthias Tröger, Nordhausen (DE); Uwe Lange, Berga (DE)

(73) Assignee: Homatherm AG (CH)

( * ) Notice: Subject to any disclaimer, the term of this patent is extended or adjusted under 35 U.S.C. 154(b) by 0 days.

(21) Appl. No.: 10/111,032

(22) PCT Filed: Sep. 13, 2000

(86) PCT No.: PCT/EP00/08925

§ 371 (c)(1), (2), (4) Date: Sep. 3, 2002

(87) PCT Pub. No.: WO02/22331

PCT Pub. Date: Mar. 21, 2002

(51) Int. Cl.
*B27N 3/08* (2006.01)

(52) U.S. Cl. ..... 524/13; 524/14

(58) Field of Classification Search ..... 524/13, 524/14, 35

See application file for complete search history.

(56) References Cited

U.S. PATENT DOCUMENTS 4,828,913 A * 5/1989 Kiss ..... 442/153
4,883,546 A * 11/1989 Kunnemeyer ..... 156/62.2
5,284,704 A * 2/1994 Kochesky et al. ..... 442/364
5,456,982 A * 10/1995 Hansen et al. ..... 428/370
5,824,246 A 10/1998 Reetz
5,847,029 A * 12/1998 Campbell ..... 524/14
6,200,682 B1 * 3/2001 Dubelsten et al. ..... 428/409
6,605,245 B1 * 8/2003 Dubelsten et al. ..... 264/446

FOREIGN PATENT DOCUMENTS

| | | |
|---|---|---|
| DE | 196 47 240 | 5/1998 |
| GB | 1 414 225 | 11/1975 |
| GB | 2 317 623 | 4/1998 |
| JP | 6108313 A | 1/1986 |
| WO | 99/56923 | 11/1999 |

* cited by examiner

*Primary Examiner*—Irina S Zemel
(74) *Attorney, Agent, or Firm*—Cantor Colburn LLP

(57) ABSTRACT

The object of the present invention is to provide board-like molded elements that can be produced in a simple manner, at low cost, and that will be more flexible and possess a more precise standard of quality than can be achieved with conventional methods, and a method for producing said elements. In order to attain this object, a method for producing board-like molded elements made from natural fibers is proposed pursuant to the invention, wherein natural fibers are mixed with bonding agents, the mixture is placed on a molding platform where it may be shaped, after which the elements are bonded, characterized in that the bonding agent is admixed in the form of material elements that at least partially form bonding agents following an activation.

11 Claims, 1 Drawing Sheet

PLATE-SHAPED MOULDING ELEMENTS BASED ON NATURAL FIBRES AND METHOD FOR THE PRODUCTION THEREOF

FIELD OF THE INVENTION

The present invention relates to a method for producing board-like molded elements made from natural fibers, wherein natural fibers are mixed with bonding agents, the mixture is placed on a molding platform and is shaped if necessary, and finally is bonded. The invention further relates to board-like molded elements pursuant to the method.

DESCRIPTION OF THE RELATED ART

In the current state of the art, methods for producing corresponding board-like molded elements, including the production of particle boards, fiberboards (hdf, mdf), cellulose panels and mats, etc., are known extensively in the art. In said methods, fibers, shavings, etc. are ordinarily mixed with liquid bonding agents in a blow process. Bonding agents in this case include urea-formaldehyde glue, phenolic adhesive, and other similar adhesives. Applications in a liquid state are rather uncommon with cellulose panels and their methods of production. The fibers are ordinarily dried and then applied. As an alternative, however, the fibers may be mixed with bonding agents into an adhesive mixture, creating a semi-moist mixture. The dried or semi-moist mixtures are placed on molding platforms, which ordinarily are continuous molded components formed by molding straps. Finally, hot-pressing is used to bind the panels that have been applied and, if necessary, shaped. The process of permeating the element with superheated steam in order to activate the adhesive is also known in the art.

Disadvantages of the known methods consist in the costly procedural steps, and the high cost of the equipment needed to prepare the mixture. Furthermore, storage presents problems, since fibers and bonding agents must initially be stored separately. After they have been mixed, the mixture must ordinarily be further processed immediately on site. The costs of molding and hot-pressing also are high, because the mixture always has a high moisture content. Ultimately, panels produced via known methods are either costly due to the moisture control that is required for their production, or are of unspecified quality due to a neglect of this parameter. Furthermore, mats and/or panels produced via conventional methods possess a high bulk density, and are thus uneconomical already in terms of material consumption. The high bulk density lends the mats and/or panels a certain rigidity, so that in practical usage they cannot be handled without breaking easily.

SUMMARY OF THE INVENTION

Proceeding from this state of the art, the object of the present invention is to provide board-like molded elements that can be produced in a simple manner at low cost, and that will be more flexible and will possess a more precise standard of quality, and a method for producing said elements. Further, mats or panels of this type are to be produced more easily and with a lower bulk density, making them more flexible while providing potential for savings with the reduced consumption of materials.

This object is attained in technical terms by expanding upon a method pursuant to the current state of the art, such that the bonding agent is admixed in the form of material elements that at least partially form bonding agents following activation.

With the invention it is now possible to prepare the natural fibers that are to be applied, and the dry material elements that will form bonding agents following activation, separately. The natural fibers and the material elements can be mixed mechanically, applied mechanically, for example via scattering, shaped in a simple manner, and then ultimately be bonded together. For the shaping, pursuant to one proposal of the invention, a mechanical process such as stripping, pressing, or some similar process is also proposed. Finally, the adhesive agent in the material elements is activated in order to bond the panels together.

According to one advantageous proposal of the invention, activation is accomplished using hot air. If desired, the solids mixture that has been applied can be pre-steamed prior to treatment with the hot air, resulting in greater stability for the mats and/or panels. Following activation with hot air, the molded element is cooled, preferably using cold air.

Natural fibers in this case may include cellulose fibers, produced, for example, from recycled paper, wood fibers, or even wood chips, mineral wool, and other vegetable fibers, etc. Almost any mixture of these fibers may be prepared.

It is also advantageous for the material elements to be fibrous, however flakes and other similar material forms are also possible. As used in the invention, "forming bonding agents following activation" can refer to the release of bonding agents adhering to material elements, the melting on of the material elements as a whole, or even the formation of multicomponent bonding agents, in that the material elements are multicomponent fibers. For example, so-called bico fibers, hot-melt fibers, etc., which are known in the art, can be used. What is important within the framework of the invention is the use of cross-linking bonding agents, for which copolymers or polyethylene can be used, which can, for example, be applied to polymer substrates, in fibrous, flaked, etc forms. The hot-air activation causes the copolymers or polyethylene sheathings to melt and to become cross-linked with the polymer substrates and with one another, creating a secure but flexible bond in the mats and/or panels. The subsequent cooling completes the cross-linking process.

One particular advantage of the invention consists in the fact that the natural fibers and the material elements can be very thoroughly mixed in a simple manner, hence it can be assumed that the molded element will possess very secure bonding over its entire volume. Furthermore, the molding mixtures can be produced in a dry state, making it possible to store or even transport mixtures. This makes the production process considerably more flexible, as the mixtures need no longer be processed immediately on site. The storage of the individual components and the mixture of the components are simplified.

Furthermore, the mixture as a whole becomes easier to handle, so that costly scattering devices and similar equipment can be eliminated. Simple, known in the art mechanical spreaders and other similar equipment are sufficient. The molding is also very simple, and the activation, for example via a blowing of hot air, is far more economical and simple than hot-pressing.

The method described produces a novel, board-like molded element made of natural fibers, which is produced by mixing material elements that will form bonding agents following activation. Panels of this type possess an established standard of quality, and can be simply and economically produced to be highly flexible.

The advantages are gained from the thorough mixing of the natural fibers on the one hand with synthetic fibers used in preparing the bonding agents on the other hand. By using a cross-linking bonding agent, the panels are made completely flexible, and possess a low bulk density. This makes the production of the panels specified in the invention economical, since less material is needed to produce the same volume. Further, the handling of the mats and/or panels is substantially improved, since they no longer tend to break, and possess the flexibility needed for proper handling. They can be pressed into gaps, they can be compressed, and they can even be thrown during transport and will not tend to break off at the edges when struck on one side. Stability can be further increased via a simple pre-steaming prior to hot-air activation.

BRIEF DESCRIPTION OF THE DRAWINGS

Further advantages and characterizing features of the invention are found in the following description with reference to the diagram. The diagram shows.

DETAILED DESCRIPTION

Figure 1:
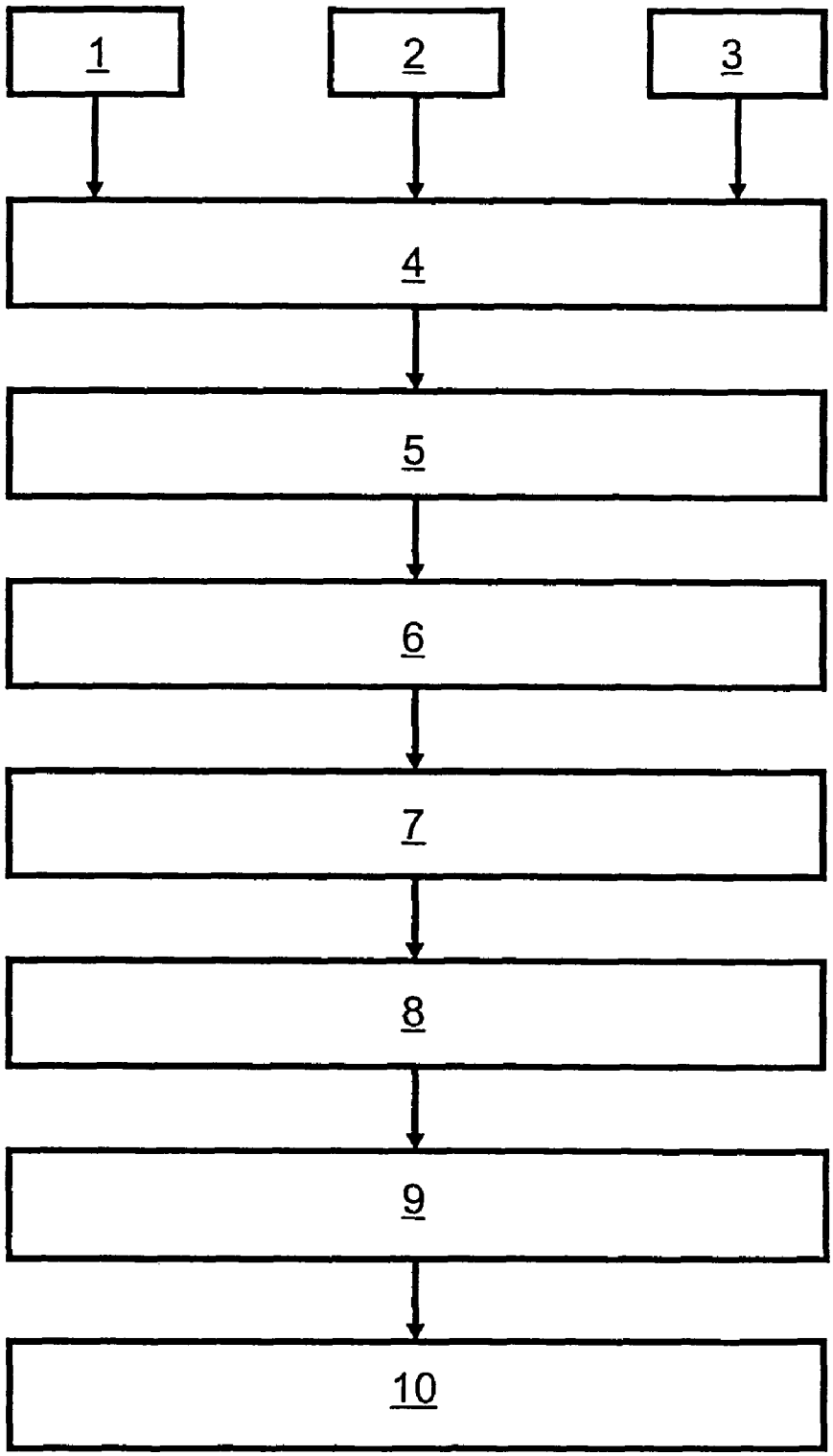
FIG. 1 a flow chart illustrating an exemplary embodiment of a procedure for the method described in the invention.

Pursuant to the exemplary embodiment illustrated here, short fibers 1, such as paper fibers, wood fibers, cellulose fibers, or other similar fibers, long fibers 2, such as jute, sisal, and other similar fibers, and the material elements that form the bonding agent 3 are mixed together. The bonding agent material elements may be in the form of threads and/or fibers, flakes, or some other form. Most importantly, corresponding substrate elements are equipped with a sheathing of cross-linking synthetics, such as polymer substrates with a copolymer or polyethylene sheathing.

The basic material, comprised of natural fibers, which may include a combination of short fibers and long fibers, a flame-retardant material 2, such as borax, if desired, and a bonding agent 3, e.g. bico fibers, are mixed together in the station 4, after which they are mechanically applied at 5 and molded into mats. These steps in the process are purely mechanical and are accomplished via known methods, with the molding being achieved via stripping or some similar method. In the exemplary embodiment shown here, the molded mat is pre-steamed in order to achieve a high level of stability in step 6. This is followed by pressing and hot-air activation in step 7, in which the moisture introduced via pre-steaming is dried out. If cross-linking bonding agents are used, then a cooling step 8 follows. Finally, in step 9, the mat or panel is made ready for use, in other words it is cut open, etc. Afterward, the panels formatted in this manner are packaged in step 10.

EXAMPLE 1

By mixing cellulose fibers equipped with flame-retardant materials with polyester/polyolefin-bico fibers, scattering the mixture mechanically, pre-steaming the scattered mat briefly, and then drying it, so that the melting temperature of the fibers is achieved everywhere in the mat, the result after cooling is a flexible insulating panel that possesses half the bulk density and twice the tensile strength of conventional cellulose insulating panels. The ratio of cellulose fibers to bico fibers in the mixture is between 4:1 and 20:1.

The above-described exemplary embodiment is intended to serve only as an illustration and not to restrict the invention.

The invention claimed is:

1. A method for producing mat formed molded elements comprising natural fibers, the method comprising the steps of:

mixing natural fibers and multicomponent fibers in order to form a mixture, wherein each of said multicomponent fibers comprises a base element being provided with a sheath of a synthetic linking substance, wherein at least the sheath forms a bonding agent upon activation;

arranging the mixture at a molding station;

molding the mixture;

pre-steaming the mixture; and activating said multicomponent fibers by subjecting the mixture to hot air, wherein setting free said bonding agent in order to provide a bonding effect for said natural fibers, thus forming said mat formed molded elements.

2. The method in accordance with claim 1, wherein the natural fibers comprise wood fibers.

3. The method in accordance with claim 1, wherein the mixing of the natural fibers and the said multicomponent fibers is accomplished mechanically.

4. The method in accordance with claim 1, wherein said molding station includes a molding platform, and said arranging further includes applying the mixture to the molding platform via scattering.

5. The method in accordance with claim 1, wherein the step of molding is accomplished mechanically.

6. The method in accordance with claim 5, wherein the step of molding is accomplished via stripping.

7. The method in accordance with claim 5, wherein the step of molding is accomplished at least partially via pressing.

8. The method in accordance with claim 1, wherein, prior to the step of activating with hot air, said mixture is thoroughly pre-steamed.

9. The method in accordance with claim 1, wherein, following the hot-air activation, cool air is fed to the molded element.

10. The method in accordance with claim 1, wherein the base element is made of a polymer.

11. The method in accordance with claim 1, wherein the sheath is made of a copolymer or polyethylene.

* * * * *